US010184499B2

(12) United States Patent
Joung et al.

(10) Patent No.: US 10,184,499 B2
(45) Date of Patent: Jan. 22, 2019

(54) HYDRAULIC CIRCUIT FOR CONSTRUCTION MACHINE

(71) Applicant: VOLVO CONSTRUCTION EQUIPMENT AB, Eskilstuna (SE)

(72) Inventors: Hea-Gyoon Joung, Busan (KR); Sung-Gon Kim, Changwon-si (KR)

(73) Assignee: Volvo Construction Equipment AB (SE)

( * ) Notice: Subject to any disclaimer, the term of this patent is extended or adjusted under 35 U.S.C. 154(b) by 335 days.

(21) Appl. No.: 14/906,141

(22) PCT Filed: Jul. 24, 2013

(86) PCT No.: PCT/KR2013/006614

§ 371 (c)(1),
(2) Date: Jan. 19, 2016

(87) PCT Pub. No.: WO2015/012423

PCT Pub. Date: Jan. 29, 2015

(65) Prior Publication Data

US 2016/0160883 A1 Jun. 9, 2016

(51) Int. Cl.
*F15B 11/16* (2006.01)
*E02F 9/22* (2006.01)

(52) U.S. Cl.
CPC ..... *F15B 11/16* (2013.01); *E02F 9/2225* (2013.01); *E02F 9/2228* (2013.01);
(Continued)

(58) Field of Classification Search
CPC ..... F15B 11/16; E02F 9/2225; E02F 9/22228; E02F 9/2267; E02F 9/2282; E02F 9/2285; E02F 9/2296; E02F 9/22; E02F 9/123
(Continued)

(56) References Cited

U.S. PATENT DOCUMENTS 5,081,837 A * 1/1992 Ueno ..... E02F 9/2239 60/421
5,277,027 A * 1/1994 Aoyagi ..... E02F 9/2232 60/420

(Continued)

FOREIGN PATENT DOCUMENTS

EP 0533953 A1 3/1993
EP 0844338 A2 5/1998

(Continued)

OTHER PUBLICATIONS

International Search Report (in English and Korean) and Written Opinion of the International Searching Authority (in Korean) for PCT/KR2013/006614, dated Apr. 23, 2014; ISA/KR.

(Continued)

*Primary Examiner* — Nathaniel E Wiehe
*Assistant Examiner* — Richard C Drake
(74) *Attorney, Agent, or Firm* — Harness, Dickey & Pierce, PLC

(57) ABSTRACT

A hydraulic circuit for a construction machine is disclosed, which can prevent a loss of pressure during a combined work. The hydraulic circuit includes a variable displacement hydraulic pump, at least two hydraulic actuators driven by hydraulic fluid that is supplied from the hydraulic pump, control valves installed in a center bypass path of the hydraulic pump and shifted to control a start, a stop, and a direction change of the hydraulic actuators, parallel flow paths having inlets branched and connected to predetermined positions on an uppermost stream side of the center bypass path and outlets connected to inlet ports of the control valves, bleed-off paths formed on the control valves other than the lowermost downstream side control valve among the control valves to selectively communicate with the center bypass path, the bleed-off paths communicating with the center bypass path when the plurality of control (Continued)

valves are shifted for a combined work, and a switching valve installed on a lowermost downstream side of the center bypass path to intercept the center bypass path when pilot signal pressure is applied.

9 Claims, 3 Drawing Sheets

(52) U.S. Cl.
CPC ..... *E02F 9/2267* (2013.01); *E02F 9/2282* (2013.01); *E02F 9/2285* (2013.01); *E02F 9/2296* (2013.01); *F15B 2211/35* (2013.01); *F15B 2211/355* (2013.01); *F15B 2211/36* (2013.01); *F15B 2211/40515* (2013.01); *F15B 2211/41554* (2013.01); *F15B 2211/45* (2013.01); *F15B 2211/575* (2013.01); *F15B 2211/6316* (2013.01); *F15B 2211/6654* (2013.01); *F15B 2211/67* (2013.01)

(58) Field of Classification Search
USPC ..... 60/421, 428, 426; 91/38
See application file for complete search history.

(56) References Cited

U.S. PATENT DOCUMENTS 5,692,377 A * 12/1997 Moriya ..... E02F 9/2242 60/421
5,941,155 A * 8/1999 Arai ..... E02F 9/123 60/468
5,950,430 A * 9/1999 Tohji ..... E02F 9/123 60/426
5,970,709 A * 10/1999 Tohji ..... E02F 9/2242 60/421
5,996,341 A * 12/1999 Tohji ..... E02F 9/2203 60/421
6,148,548 A * 11/2000 Tohji ..... E02F 9/2242 37/348
6,708,490 B2 * 3/2004 Toji ..... E02F 9/2239 60/421
7,581,392 B2 * 9/2009 Jeon ..... B62D 11/005 60/421
7,594,395 B2 * 9/2009 Oka ..... F15B 11/17 60/421
7,614,225 B2 * 11/2009 Kim ..... B62D 11/005 60/421
8,104,276 B2 * 1/2012 Lee ..... E02F 9/2239 60/421
8,572,957 B2 * 11/2013 Ikeda ..... E02F 9/2239 60/421
8,818,651 B2 8/2014 Joung et al.
9,051,712 B2 * 6/2015 Kodaka ..... E02F 3/962
9,103,355 B2 8/2015 Ku et al.
9,194,382 B2 11/2015 Shin et al.
9,249,812 B2 * 2/2016 Jeon ..... E02F 9/2232
9,903,097 B2 * 2/2018 Hashimoto ..... F15B 11/16
9,932,994 B2 * 4/2018 Hashimoto ..... F15B 13/0402
2007/0193262 A1 * 8/2007 Iwamoto ..... B60W 10/06 60/421
2007/0240562 A1 10/2007 Kim
2010/0043420 A1 2/2010 Ikeda et al.
2013/0121852 A1 5/2013 Joung et al.
2014/0238010 A1 * 8/2014 Joung ..... F15B 11/17 60/428
2015/0040552 A1 * 2/2015 Hashimoto ..... F15B 11/17 60/429
2015/0361995 A1 * 12/2015 Joung ..... F15B 11/024 60/327
2017/0276151 A1 * 9/2017 Joung ..... F15B 11/10
2018/0002897 A1 * 1/2018 Hashimoto ..... F15B 11/16

FOREIGN PATENT DOCUMENTS

JP H11107328 A 4/1999
JP 2004028264 A 1/2004
KR 19950002981 3/1995
KR 100753986 B1 8/2007
KR 100961433 B1 6/2010
KR 100998614 B1 12/2010
KR 102011007258 A 6/2011
WO WO-9218711 A1 10/1992
WO WO-2013-002429 A1 1/2013

OTHER PUBLICATIONS

Extended European Search Report issued by European Patent Office (EPO) dated Feb. 1, 2017 regarding corresponding EP Patent Application No. 13890170.7 (8 pages).
Notification of Reasons for Refusal (in Korean) issued by the Korean Intellectual Property Office (KIPO) dated Feb. 2, 2017 concerning the corresponding Korean Patent Application (4 pages).

* cited by examiner

HYDRAULIC CIRCUIT FOR CONSTRUCTION MACHINE

CROSS-REFERENCE TO RELATED APPLICATION

This application is a 371 U.S. National Stage of International Application No. PCT/KR2013/006614, filed on Jul. 24, 2013. The entire disclosure of the above application is incorporated herein by reference.

TECHNICAL FIELD

The present invention relates to a hydraulic circuit for a construction machine, and more particularly, to a hydraulic circuit for a construction machine, which can prevent a loss of pressure during a combined work.

BACKGROUND OF THE INVENTION

A hydraulic circuit for a construction machine in the related art, as illustrated in FIG. 1, includes a variable displacement hydraulic pump (hereinafter referred to as a "hydraulic pump") 1 connected to an engine (not illustrated) or the like; at least two hydraulic actuators 2, 3, and 4 driven by hydraulic fluid that is supplied from the hydraulic pump 1; control valves 6, 7, and 8 installed in a center bypass path 5 of the hydraulic pump 1 and shifted to control a start, stop, and direction change of the hydraulic actuators 2, 3, and 4; a parallel flow path 9 having inlets branched and connected to predetermined positions on an uppermost stream side of the center bypass path 5 and outlets connected to inlet ports of the control valves 6, 7, and 8; a first orifice 11 installed in a predetermined position of a first path 10 having an inlet branched and connected to a predetermined position of the parallel flow path 9 and an outlet connected to an inlet port of the control valve 7; and a second orifice 13 installed in a predetermined position of a second path 12 having an inlet branched and connected to the predetermined position of the parallel flow path 9 and an outlet connected to an inlet port of the lowermost downstream side control valve 8.

If an operation lever (RCV) (not illustrated) is operated to operate the hydraulic actuators 2, 3, and 4 for a combined work, pilot signal pressure from a pilot pump (not illustrated) is applied to the control valves 6, 7, and 8 to shift spools thereof, and thus it becomes possible to control the hydraulic fluid that is supplied from the hydraulic pump 1 to the hydraulic actuators 2, 3, and 4.

In this case, if the control valves 6 and 7, the control valves 6 and 8, or the control valves 7 and 8 are shifted by the applied pilot signal pressure, for example, if the control valves 6 and 7 are shifted, the hydraulic fluid of the hydraulic pump 1 is supplied to the hydraulic actuator 2 via the upstream side control valve 6 of which the spool is shifted, and the hydraulic fluid of the hydraulic pump 1 is supplied to the hydraulic actuator 3 via the parallel flow path 9, the first path 10, and the downstream side control valve 7 of which the spool is shifted.

In this case, the center bypass path between the upstream side control valve 6 and the downstream side control valve 7 is closed by the shifting of the upstream side control valve 6, and thus the hydraulic fluid of the hydraulic pump 1 is supplied to the inlet port of the downstream side control valve 7 only through the parallel flow path 9. Further, since the hydraulic fluid of the hydraulic pump 1 is supplied to the inlet port of the downstream side control valve 7 via the first orifice 11 that is installed on the first path 10, an excessive pressure loss occurs during the combined work, and thus energy efficiency is decreased.

SUMMARY OF THE INVENTION

Accordingly, the present invention has been made to solve the above-mentioned problems occurring in the related art, and one subject to be achieved by the present invention is to provide a hydraulic circuit for a construction machine, which can heighten energy efficiency and improve fuel economy through prevention of a pressure loss when a boom, an arm, or a swing device is operated for a combined work.

Technical Solution

In accordance with an aspect of the present invention, there is provided a hydraulic circuit for a construction machine, which includes a variable displacement hydraulic pump; at least two hydraulic actuators driven by hydraulic fluid that is supplied from the hydraulic pump; control valves installed in a center bypass path of the hydraulic pump and shifted to control a start, stop, and direction change of the hydraulic actuators; parallel flow paths having inlets branched and connected to predetermined positions on an uppermost stream side of the center bypass path and outlets connected to inlet ports of the control valves; bleed-off paths formed on the control valves excluding the lowermost downstream side control valve among the control valves to selectively communicate with the center bypass path, the bleed-off paths communicating with the center bypass path when the control valves are shifted for a combined work; and a switching valve installed on a lowermost downstream side of the center bypass path to intercept the center bypass path when a pilot signal pressure is applied.

The hydraulic circuit for a construction machine in accordance with the aspect of the present invention may further includes, as means for applying the pilot signal pressure to shift the switching valve, a shuttle valve selecting the relatively higher pilot signal pressure of the pilot signal pressures applied to the upstream and downstream side control valves on which the bleed-off paths are formed and applying the selected pilot signal pressure to the switching valve.

The hydraulic circuit for a construction machine in accordance with the aspect of the present invention may further include, as means for applying the pilot signal pressure to shift the switching valve, pressure sensors measuring the pilot signal pressures applied to the upstream and downstream side control valves on which the bleed-off paths are formed; a controller calculating the pilot signal pressures measured by the pressure sensors and outputting an electric signal corresponding to the calculated values; and an electro proportional control valve generating a secondary pressure corresponding to the electric signal that is applied from the controller and applying the secondary pressure to the switching valve.

The controller may compare levels of the pilot signal pressures applied to the upstream and downstream side control valves on which the bleed-off paths are formed, and if the pilot signal pressure that is applied to the upstream side control valve is relatively higher than the pilot signal pressure that is applied to the downstream side control valve, the controller outputs the electric signal corresponding to the control characteristic of the upstream side control valve to the electro proportional control valve, and if the pilot signal pressure that is applied to the upstream side control valve is relatively lower than the pilot signal pressure that is applied to the downstream side control valve, the controller outputs the electric signal corresponding to the control characteristic of the downstream side control valve to the electro proportional control valve.

The hydraulic circuit for a construction machine in accordance with the aspect of the present invention may further include a first orifice installed in a predetermined position of a first path having an inlet branched and connected to a predetermined position of the parallel flow path and an outlet connected to an inlet port of the downstream side control valve; and a second orifice installed in a predetermined position of a second path having an inlet branched and connected to the predetermined position of the parallel flow path and an outlet connected to an inlet port of the lowermost downstream side control valve.

Of the upstream and downstream side control valves on which the bleed-off paths are formed, the hydraulic actuator connected to the upstream side control valve may be a boom cylinder, and the hydraulic actuator connected to the downstream side control valve may be an arm cylinder.

Advantageous Effect

According to the embodiment of the present invention having the above-described configuration, in the case of operating the boom, the arm, or the swing device for the combined work, the control valves are shifted to open the center bypass path of the upstream side control valve, and thus the hydraulic fluid of the hydraulic pump can be supplied to the downstream side control valve through the center bypass path and the parallel flow path. Accordingly, since the pressure loss can be prevented during the combined work, the energy efficiency can be heightened, and the fuel economy can be improved.

BRIEF DESCRIPTION OF THE DRAWINGS

The above objects, other features and advantages of the present invention will become more apparent by describing the preferred embodiments thereof with reference to the accompanying drawings, in which.

EXPLANATION OF REFERENCE NUMERALS FOR MAIN PARTS IN THE DRAWING

Figure 1:
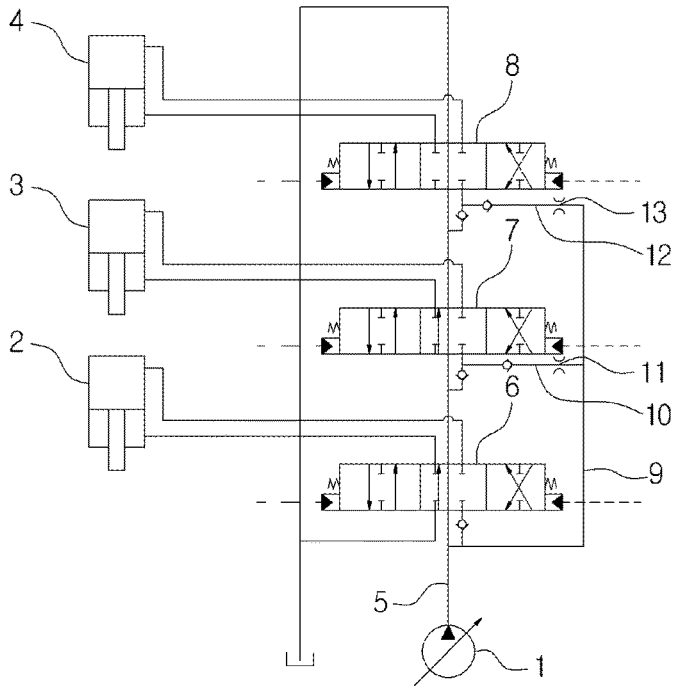
FIG. 1 is a diagram illustrating a hydraulic circuit for a construction machine in the related art.

1: hydraulic pump
2, 3, 4: hydraulic actuator
5: center bypass path
6, 7, 8: control valve
9: parallel flow path
10: first path
11: first orifice
12: second path
13: second orifice
14: switching valve
15: shuttle valve
16, 17: pressure sensor
18: controller
19: electro proportional control valve

DETAILED DESCRIPTION OF THE INVENTION

Hereinafter, a hydraulic circuit for a construction machine in accordance with preferred embodiments of the present invention will be described in detail with reference to the accompanying drawings.

Figure 2:
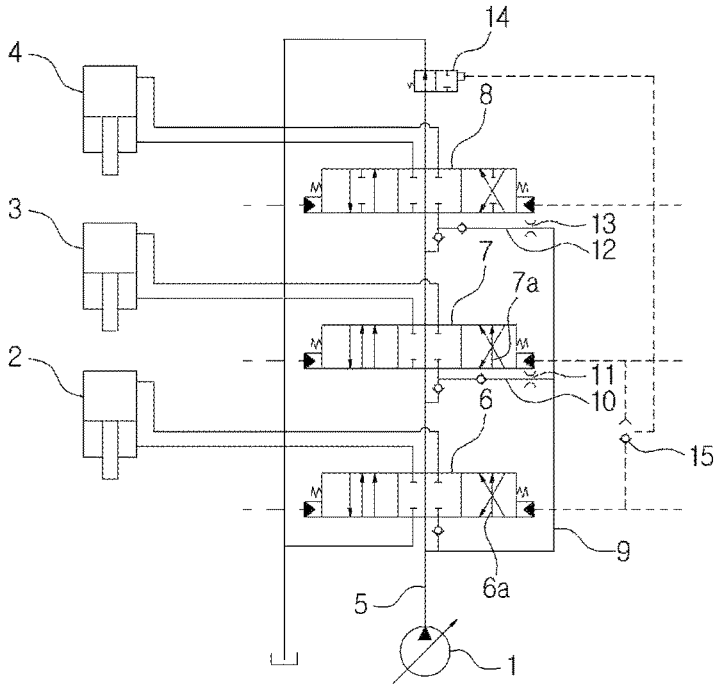
Prior Art FIG. 2
FIG. 2 is a diagram illustrating a hydraulic circuit for a construction machine according to an embodiment of the present invention.
Figure 3:
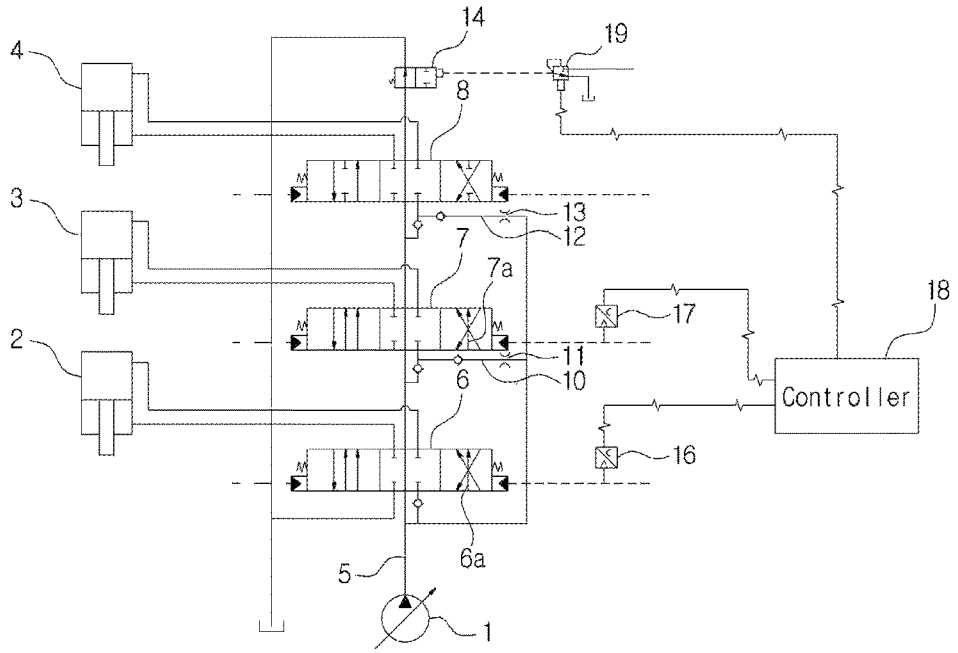
FIG. 3 is a diagram illustrating a hydraulic circuit for a construction machine according to another embodiment of the present invention.
Figure 4:
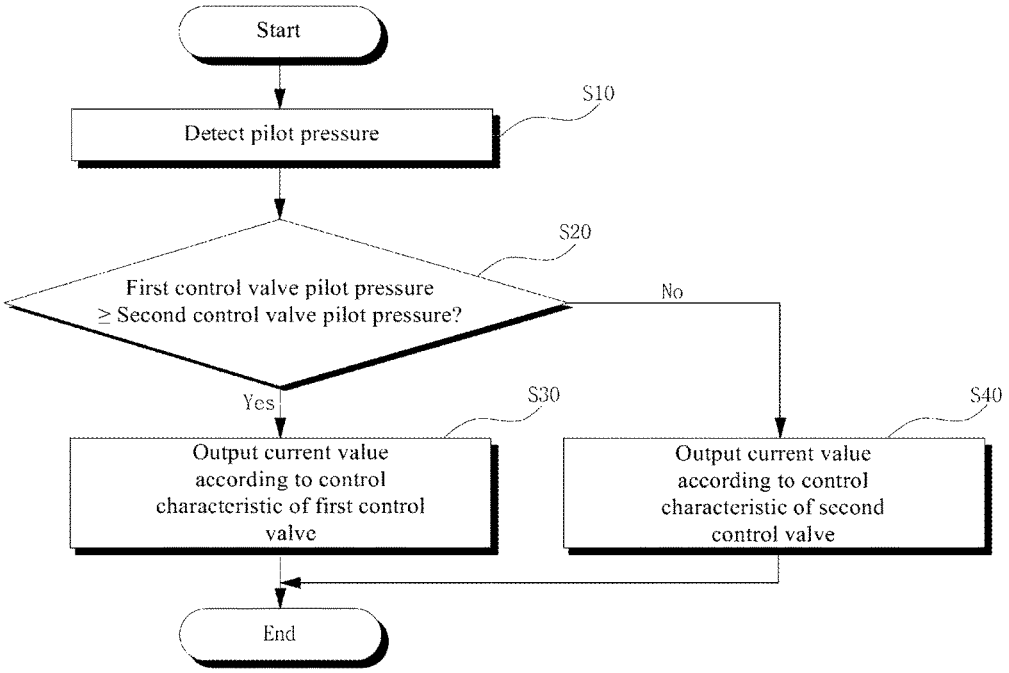
FIG. 4 is a diagram illustrating a control algorithm of a switching valve in a hydraulic circuit for a construction machine according to an embodiment of the present invention.

FIG. 2 is a diagram illustrating a hydraulic circuit for a construction machine according to an embodiment of the present invention, and FIG. 3 is a diagram illustrating a hydraulic circuit for a construction machine according to another embodiment of the present invention. FIG. 4 is a diagram illustrating a control algorithm of a switching valve in a hydraulic circuit for a construction machine according to an embodiment of the present invention.

Referring to FIGS. 2 and 4, a hydraulic circuit for a construction machine according to an embodiment of the present invention includes a variable displacement hydraulic pump (hereinafter referred to as a "hydraulic pump") 1 connected to an engine or the like; at least two hydraulic actuators 2, 3, and 4 driven by hydraulic fluid that is supplied from the hydraulic pump 1; control valves 6, 7, and 8 installed in a center bypass path 5 of the hydraulic pump 1 and shifted to control a start, stop, and direction change of the hydraulic actuators 2, 3, and 4; a parallel flow path 9 having inlets branched and connected to predetermined positions on an uppermost stream side of the center bypass path 5 and outlets connected to inlet ports of the control valves 6, 7, and 8; bleed-off paths 6*a* and 7*a* formed on spools of the control valves 6 and 7 excluding the lowermost downstream side control valve 8 among the control valves 6, 7, and 8 to selectively communicate with the center bypass path 5, the bleed-off paths 6*a* and 7*a* communicating with the center bypass path 5 to supply the hydraulic fluid of the hydraulic pump 1 to an inlet port of the downstream side control valve 7 among the control valves 6 and 7 through the center bypass path 5 and the parallel flow path 9 when the control valves 6 and 7 are shifted for a combined work; and a switching valve 14 installed on a lowermost downstream side of the center bypass path 5 to intercept the center bypass path 5 when a pilot signal pressure is applied thereto.

The hydraulic circuit for a construction machine in accordance with the aspect of the present invention may further includes, as means for applying the pilot signal pressure to shift the switching valve 14, a shuttle valve 15 selecting the relatively higher pilot signal pressure of the pilot signal pressures applied to the upstream and downstream side control valves 6 and 7 on which the bleed-off paths 6*a* and 7*a* are formed and applying the selected pilot signal pressure to the switching valve 14.

The hydraulic circuit for a construction machine in accordance with the aspect of the present invention may further include, as means for applying the pilot signal pressure to shift the switching valve 14, pressure sensors 16 and 17 measuring the pilot signal pressures applied to the upstream and downstream side control valves 6 and 7 on which the bleed-off paths 6*a* and 7*a* are formed; a controller 18 calculating the pilot signal pressures measured by the pressure sensors 16 and 17 and outputting an electric signal corresponding to the calculated values; and an electro proportional control valve 19 generating a secondary pressure corresponding to the electric signal that is applied from the controller 18 and applying the secondary pressure to the switching valve 14.

The controller 18 may compare levels of the pilot signal pressures applied to the upstream and downstream side control valves 6 and 7 on which the bleed-off paths 6*a* and 7*a* are formed, and if the pilot signal pressure that is applied to the upstream side control valve 6 is relatively higher than the pilot signal pressure that is applied to the downstream side control valve 7, output the electric signal corresponding to the control characteristic of the upstream side control valve 6 to the electro proportional control valve 19, and if the pilot signal pressure that is applied to the upstream side control valve 6 is relatively lower than the pilot signal pressure that is applied to the downstream side control valve 7, output the electric signal corresponding to the control characteristic of the downstream side control valve 7 to the electro proportional control valve 19.

The hydraulic circuit for a construction machine in accordance with the aspect of the present invention may further include a first orifice 11 installed in a predetermined position of a first path 10 having an inlet branched and connected to a predetermined position of the parallel flow path 9 and an outlet connected to an inlet port of the downstream side control valve 7; and a second orifice 13 installed in a predetermined position of a second path 12 having an inlet branched and connected to the predetermined position of the parallel flow path 9 and an outlet connected to an inlet port of the lowermost downstream side control valve 8.

Of the upstream and downstream side control valves 6 and 7 on which the bleed-off paths 6*a* and 7*a* are formed, the hydraulic actuator connected to the upstream side control valve 6 may be a boom cylinder, the hydraulic actuator connected to the downstream side control valve 7 may be an arm cylinder, and the hydraulic actuator connected to the lowermost downstream side control valve 8 may be a bucket cylinder.

Referring to FIG. 2, if an operation lever (RCV) (not illustrated) is operated to operate the hydraulic actuators 2, 3, and 4 for a combined work, pilot signal pressure from a pilot pump (not illustrated) is applied to left or right ends of the control valves 6, 7, and 8 to shift spools thereof, and thus it becomes possible to control the hydraulic fluid that is supplied from the hydraulic pump 1 to the hydraulic actuators 2, 3, and 4.

As an example, if the pilot signal pressure is applied to the right ends of the control valves 6 and 7 to shift the spools in leftward direction in the drawing, the relatively high pilot signal pressure, which is a part of the pilot signal pressure that is applied to the control valves 6 and 7, is selected by the shuttle valve 15, and the selected pilot signal pressure is applied to the switching valve 14 to shift the spool thereof. Accordingly, the lowermost downstream side of the center bypass path 5 is intercepted.

Accordingly, the hydraulic fluid of the hydraulic pump 1 is supplied to the hydraulic actuator 2 via the upstream side control valve 6, of which the spool is shifted, while the hydraulic fluid of the hydraulic pump 1 passes through the parallel flow path 9 and the first path 10 and is supplied to the hydraulic actuator 3 via the downstream side control valve 7 of which the spool is shifted.

At this time, even in the case where the spool of the upstream side control valve 6 is shifted, the center bypass path provided between the upstream side control valve 6 and the downstream side control valve 7 is kept in an open state by means of the bleed-off path 6*a* of the upstream side control valve 6.

Accordingly, the hydraulic fluid of the hydraulic pump 1 is supplied to the downstream side control valve 7 through the center bypass path 5 and the bleed-off path 6*a* of the upstream side control valve 6. At the same time, the hydraulic fluid of the hydraulic pump 1 is supplied to the inlet port of the downstream side control valve 7 via the first orifice 11 installed between the parallel flow path 9 and the first path 10.

That is, in the case of shifting the upstream side control valve 6 and the downstream side control valve 7 for the combined work, the center bypass path 5 in the upstream side control valve 6 is kept in an open state by means of the bleed-off path 6*a*. Due to this, the hydraulic fluid of the hydraulic pump 1 flows through the center bypass path 5 and the parallel flow path 9 and is supplied to the hydraulic actuator 3 via the downstream side control valve 7. Accordingly, even in the case of shifting the upstream side control valve 6 and the downstream side control valve 7 for the combined work, a pressure loss can be prevented with the operability maintained.

Referring to FIGS. 3 and 4, if the operation lever (RCV) (not illustrated) is operated to operate the hydraulic actuators 2, 3, and 4 for the combined work, the pilot signal pressure from the pilot pump (not illustrated) is applied to the left or right ends of the control valves 6, 7, and 8 to shift the spools thereof, and thus it becomes possible to control the hydraulic fluid that is supplied from the hydraulic pump 1 to the hydraulic actuators 2, 3, and 4.

As an example, if the pilot signal pressure is applied to the right ends of the control valves 6 and 7 to shift the spools in the leftward direction in the drawing, the pilot signal pressure that is applied to the upstream side control valve 6 and the downstream side control valve 7 is measured by the pressure sensors 16 and 17, and a detection signal is transmitted to the controller 18 (S10). Accordingly, the controller 18 calculates a specific current value that corresponds to the input pilot signal pressure.

As at S20, the controller compares the pilot signal pressure that is applied to the upstream side control valve 6 with the pilot signal pressure that is applied to the downstream side control valve 7, and if the pilot signal pressure that is applied to the upstream side control valve 6 is relatively higher than the pilot signal pressure that is applied to the downstream side control valve 7, the controller proceeds to S30, while if the pilot signal pressure that is applied to the upstream side control valve 6 is relatively lower than the pilot signal pressure that is applied to the downstream side control valve 7, the controller proceeds to S40.

As at S30, if the pilot signal pressure that is applied to the upstream side control valve 6 is relatively higher than the pilot signal pressure that is applied to the downstream side control valve 7, the controller outputs the specific current value that corresponds to the control characteristic of the upstream side control valve 6 to the electro proportional control valve 19.

As at S40, if the pilot signal pressure that is applied to the upstream side control valve 6 is relatively lower than the pilot signal pressure that is applied to the downstream side control valve 7, the controller outputs the specific current value that corresponds to the control characteristic of the downstream side control valve 7 to the electro proportional control valve 19.

The electro proportional control valve 19 generates secondary pressure to correspond to the current value that is applied from the controller 18 to the electro proportional control valve 19, and the secondary pressure that is generated by the electro proportional control valve 19 is applied to the switching valve 14 and shifts the spool of the switching valve 14 to intercept the lowermost downstream side of the center bypass path 5.

Although the present invention has been described with reference to the preferred embodiments in the attached figures, it is to be understood that various equivalent modifications and variations of the embodiment can be made by a person having an ordinary skill in the art without departing from the spirit and scope of the present invention.

INDUSTRIAL APPLICABILITY

According to the present invention having the above-described configuration, in the case of operating the boom, the arm, or the swing device for the combined work, the pressure loss can be prevented. Accordingly, the energy efficiency and the fuel economy can be heightened.

What is claimed is:

1. A hydraulic circuit for a construction machine comprising:

a variable displacement hydraulic pump;

at least two hydraulic actuators driven by hydraulic fluid that is supplied from the hydraulic pump;

control valves installed in a center bypass path of the hydraulic pump and shifted to control a start, stop, and direction change of the hydraulic actuators;

a parallel flow path having inlets branched and connected to predetermined positions on an uppermost stream side of the center bypass path and outlets connected to inlet ports of the control valves;

bleed-off paths formed on the control valves excluding the lowermost downstream side control valve among the control valves to selectively communicate with the center bypass path, the bleed-off paths communicating with the center bypass path when the control valves are shifted for a combined work;

a switching valve installed on a lowermost downstream side of the center bypass path to intercept the center bypass path when a pilot signal pressure is applied; and for applying the pilot signal pressure to shift the switching valve, a shuttle valve selecting the relatively higher pilot signal pressure of the pilot signal pressures applied to the upstream and downstream side control valves on which the bleed-off paths are formed and applying the selected pilot signal pressure to the switching valve.

2. The hydraulic circuit according to claim 1, further comprising, for applying the pilot signal pressure to shift the switching valve:

pressure sensors measuring the pilot signal pressures applied to the upstream and downstream side control valves on which the bleed-off paths are formed;

a controller calculating the pilot signal pressures measured by the pressure sensors and outputting an electric signal corresponding to the calculated values; and an electro proportional control valve generating a secondary pressure corresponding to the electric signal that is applied from the controller and applying the secondary pressure to the switching valve.

3. The hydraulic circuit according to claim 2, wherein the controller compares levels of the pilot signal pressures applied to the upstream and downstream side control valves on which the bleed-off paths are formed with each other, and if the pilot signal pressure that is applied to the upstream side control valve is relatively higher than the pilot signal pressure that is applied to the downstream side control valve, outputs the electric signal corresponding to the control characteristic of the upstream side control valve to the electro proportional control valve, and if the pilot signal pressure that is applied to the upstream side control valve is relatively lower than the pilot signal pressure that is applied to the downstream side control valve, the controller outputs the electric signal corresponding to the control characteristic of the downstream side control valve to the electro proportional control valve.

4. The hydraulic circuit according to claim 1, further comprising:

a first orifice installed in a predetermined position of a first path having an inlet branched and connected to a predetermined position of the parallel flow path and an outlet connected to an inlet port of the downstream side control valve; and a second orifice installed in a predetermined position of a second path having an inlet branched and connected to the predetermined position of the parallel flow path and an outlet connected to an inlet port of the lowermost downstream side control valve.

5. The hydraulic circuit according to claim 1, wherein, of the upstream and downstream side control valves on which the bleed-off paths are formed, the hydraulic actuator connected to the upstream side control valve is a boom cylinder, and the hydraulic actuator connected to the downstream side control valve is an arm cylinder.

6. A hydraulic circuit for a construction machine comprising:

a variable displacement hydraulic pump;

at least two hydraulic actuators driven by hydraulic fluid that is supplied from the hydraulic pump;

control valves installed in a center bypass path of the hydraulic pump and shifted to control a start, stop, and direction change of the hydraulic actuators;

a parallel flow path having inlets branched and connected to predetermined positions on an uppermost stream side of the center bypass path and outlets connected to inlet ports of the control valves;

bleed-off paths formed on the control valves excluding the lowermost downstream side control valve among the control valves to selectively communicate with the center bypass path, the bleed-off paths communicating with the center bypass path when the control valves are shifted for a combined work; and a switching valve installed on a lowermost downstream side of the center bypass path to intercept the center bypass path when a pilot signal pressure is applied, the hydraulic circuit further comprises the following for applying the pilot signal pressure to shift the switching valve:

pressure sensors measuring the pilot signal pressures applied to the upstream and downstream side control valves on which the bleed-off paths are formed;

a controller calculating the pilot signal pressures measured by the pressure sensors and outputting an electric signal corresponding to the calculated values; and an electro proportional control valve generating a secondary pressure corresponding to the electric signal that is applied from the controller and applying the secondary pressure to the switching valve.

7. The hydraulic circuit according to claim 6, wherein the controller compares levels of the pilot signal pressures applied to the upstream and downstream side control valves on which the bleed-off paths are formed with each other, and if the pilot signal pressure that is applied to the upstream side control valve is relatively higher than the pilot signal pressure that is applied to the downstream side control valve, outputs the electric signal corresponding to the control characteristic of the upstream side control valve to the electro proportional control valve, and if the pilot signal pressure that is applied to the upstream side control valve is relatively lower than the pilot signal pressure that is applied to the downstream side control valve, the controller outputs the electric signal corresponding to the control characteristic of the downstream side control valve to the electro proportional control valve.

8. The hydraulic circuit according to claim 6, further comprising:

a first orifice installed in a predetermined position of a first path having an inlet branched and connected to a predetermined position of the parallel flow path and an outlet connected to an inlet port of the downstream side control valve; and a second orifice installed in a predetermined position of a second path having an inlet branched and connected to the predetermined position of the parallel flow path and an outlet connected to an inlet port of the lowermost downstream side control valve.

9. The hydraulic circuit according to claim 6, wherein, of the upstream and downstream side control valves on which the bleed-off paths are formed, the hydraulic actuator connected to the upstream side control valve is a boom cylinder, and the hydraulic actuator connected to the downstream side control valve is an arm cylinder.

* * * * *